United States Patent [19]

Cotter et al.

[11] Patent Number: 4,823,441

[45] Date of Patent: Apr. 25, 1989

[54] HIGHLY ALKALINE DETERGENT PELLETS AND PROCESS THEREFOR

[75] Inventors: Terrence Cotter, Southgate; Theodore Anderson, Grosse Ile; Robert Gansser, Riverview, all of Mich.; Louis Kryk, Windsor, Canada

[73] Assignee: Diversey Corporation, Mississauga, Canada

[21] Appl. No.: 118,959

[22] Filed: Nov. 10, 1987

[51] Int. Cl.[4] ..... C11D 13/20; C11D 17/06

[52] U.S. Cl. ..... 23/313 R; 252/99; 252/103; 252/135; 252/174; 252/156

[58] Field of Search ..... 252/174, 135, 103, 156, 252/99; 23/293 A, 293 S, 313 R; 134/29, 36

[56] References Cited

U.S. PATENT DOCUMENTS 2,987,483 6/1961 Brooker ..... 252/138

FOREIGN PATENT DOCUMENTS 0233316 3/1926 United Kingdom ..... 23/293 A

*Primary Examiner*—Paul Lieberman
*Assistant Examiner*—Kathleen Markowski
*Attorney, Agent, or Firm*—Arnold S. Weintraub

[57] ABSTRACT

Highly alkaline detergent compositions are prepared by mixing together, in a mixing device, a melt of alkaline material with a heat-alkaline sensitive material, such as, an alkali metal complex phosphate sequestrant and/or an active-chlorine source. The resulting mixture is, then, pelletized on a chill belt. Because of the short contact time between the molten alkaline material and the sequestrant and the rapid solidification, reversion of the sequestrant, particularly, a phosphate sequestrant, is substantially reduced.

8 Claims, 1 Drawing Sheet

HIGHLY ALKALINE DETERGENT PELLETS AND PROCESS THEREFOR

BACKGROUND OF THE INVENTION

1. Field of the Invention

This invention concerns detergent compositions. More particularly, this invention concerns highly alkaline detergent compositions. Even more particularly, the present invention concerns pellets of highly alkaline detergents and processes therefor.

2. Prior Art

The use of highly alkaline detergent compositions for warewashing is widely known. There is a wealth of prior art which teaches alkaline powders, flakes, emulsions, liquids and the like.

Likewise, the art has taught that the incorporation of adjuvants, such as, surfactants, chlorine-sources, chelants, sequestrants and the like is highly desirable in alkaline detergents and especially, in highly alkaline detergents. Furthermore, the art has recognized that the inclusion of complex metal phosphates in highly alkaline detergents is desirable in not only enhancing detergency but, also, because of their sequestering capabilities in hard water environments. However, the art has further recognized the inherent problems of phosphate reversion and the degradation of active-chlorine sources in highly alkaline environments and has sought suitable solutions therefor.

With respect to the phosphate problem, the art has directed its attention to either finding suitable alternative replacements for phosphates, such as alkali metal gluconates, nitrilotriacetates and the like, or to reducing the amount of reversion of the complex phosphate in such alkaline systems.

The use of alternates has not met with much market success. Recently, though, the art has seen the advent of solid, cast, brick-type, highly alkaline detergents, which contain both alkaline materials and complex phosphates. While such detergents have a high percentage of active phosphate when first formulated, they quickly lose active-phosphate content because of the reversion encountered during processing due to high processing temperatures and the like. In spite of this, these cast solid detergents have enjoyed wide commercial success because of their ease of handling and the like. These highly alkaline cast detergents are more particularly described in Fernholz et al, U.S. Pat. Nos. 4,569,780 and 4,569,781, the disclosures of which are hereby incorporated by reference.

Regarding the problem of chlorine degradation, the art has paid little attention thereto, other than proposing the use of plugs of active-chlorine employed within solid, cast detergent bricks.

However, and as noted above, the art still requires means and methods for decreasing phosphate reversion and reducing the amount of chlorine degradation in highly alkaline detergent products. It is to this to which the present invention is directed.

SUMMARY OF THE INVENTION

In accordance with the present invention, pellets of highly alkaline detergent compositions are prepared by:

(a) heating an aqueous mixture of an alkaline material or a mixture of alkaline materials or a concentrated aqueous alkaline material or materials; to an elevated temperature ranging from about 140° F. to about 200° F.;

(b) dispensing the concentrated aqueous alkaline material or melt into a mixing device;

(c) admixing a heat-alkaline sensitive material with the concentrated material in the mixing device to form a detergent mixture;

(d) feeding the detergent mixture into a distribution box; and (e) dropping droplets of the detergent mixture from the distribution box onto a chill belt to form pellets thereof.

The resulting pellets are highly alkaline detergent pellets having effective levels of heat-alkaline sensitive material and alkaline material. Because of shorter contact times between the heat-alkaline sensitive material and the alkaline material the degradation thereof is reduced. Furthermore, because the mixture is rapidly chilled to a solid pellet, degradation is further reduced.

Representative of the type of heat-alkaline sensitive material contemplated for use herein are the complex phosphate sequestrants.

The process of the present invention further permits easy inclusion of surfactants, thickeners and the like. The present process, also, permits inclusion of active-chlorine containing compounds, with significantly reduced degradation, because of the rapid chilling of the mixture into solid pellets and the short contact time between the components while in the molten state.

For a more complete understanding of the present invention reference is made to the following detailed description and accompanying drawing. In the drawing, like reference characters refer to like parts throughout the views, in which:

DESCRIPTION OF THE PREFERRED EMBODIMENTS

Figure 1:
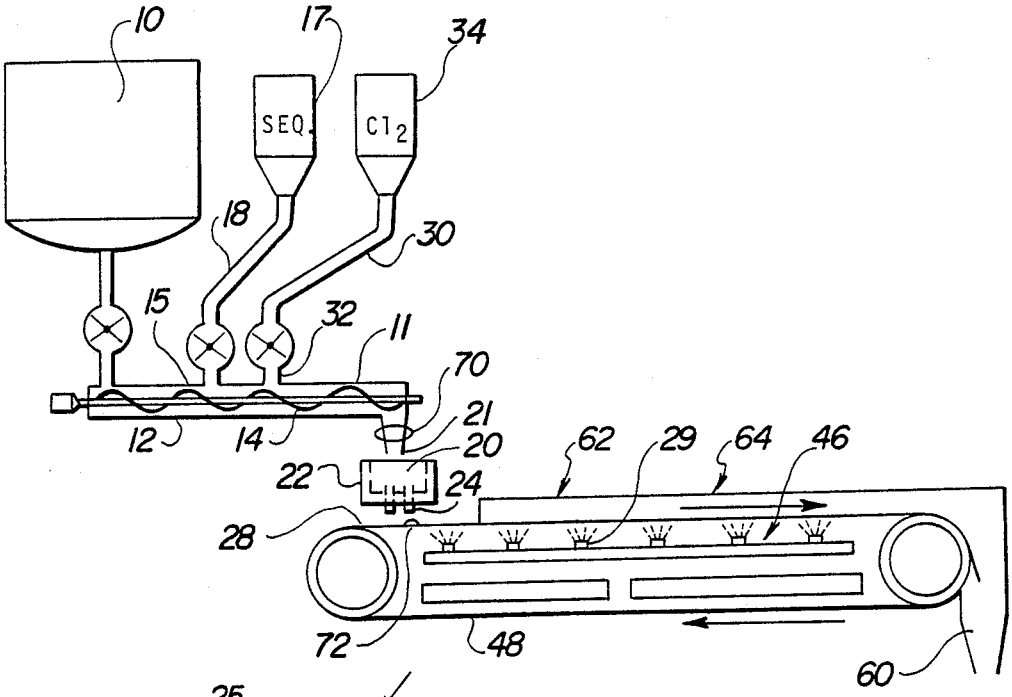
FIG. 1 is a schematic plan of the process hereof.
Figure 2:
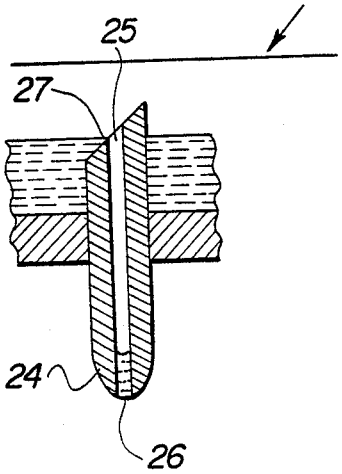
FIG. 2 is a cross-sectional view of a dropping tube mounted in a distribution box used in the process hereof.
Figure 3:
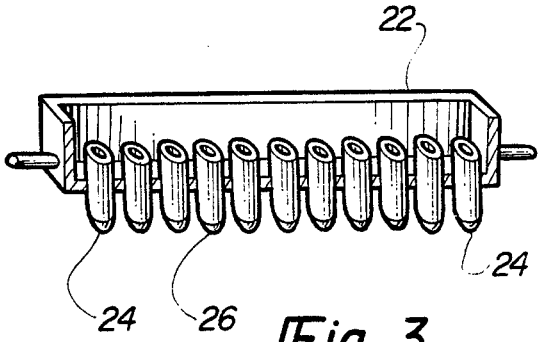
FIG. 3 is a plan view of the distribution box.

Now, and with reference to the drawing, and in particular FIG. 1, there is depicted therein a process for preparing highly alkaline detergent pellets in accordance herewith. The process hereof, generally, comprises:

(a) heating an aqueous alkaline material or a mixture of alkaline materials or a concentrated aqueous alkaline material or materials to an elevated temperature ranging from about 140° F. to about 200° F.;

(b) feeding the highly alkaline concentrated material into a mixing device;

(c) admixing a heat-alkaline sensitive material with the concentrated mixture in the mixing device;

(d) feeding the admixture into a distribution box; and (e) dropping droplets of the admixture from the distribution box onto a chill belt to form homogeneous detergent pellets.

More particularly, the present invention contemplates first forming a highly alkaline aqueous solution, suspension or melt. This is achieved in a mixing vat 10 wherein an aqueous alkaline material is raised to an elevated temperature sufficient to maintain the alkaline material in a liquid state. Ordinarily, the temperature in the vat 10 will range from about 140° F. to about 200° F. where a "hot" process is used.

The highly alkaline aqueous material can be either initially a highly concentrated form (e.g. a 74 percent concentrated aqueous form) or a reduced concentration aqueous form which is, then, concentrated to elevated concentrations.

In using a reduced concentration aqueous material, after the initial solution, suspension or melt is formed, the concentration of alkaline material in the melt is raised, by the addition thereto of further amounts of alkaline material. The alkaline material is ordinarily added in an anhydrous state, such as beads, flakes or other solid forms thereof. The addition of the anhydrous form is undertaken at the same elevated temperatures to maintain the liquid or molten state of the melt.

With mixing, the anhydrous alkaline material is added thereto to raise the concentration of alkaline material in the vat 10 to about 69 percent to about 80 percent, by weight, or higher, based on the total weight of the aqueous solution or melt in the vat 10. The alkaline material, which is hydratable, hydrates or ties up the water in the solution and, thus, no further water is added to the vat 10.

After mixing, the highly alkaline solution is fed, such as by gravity, pumping or the like, into a mixing device, such as, a feed tube 12 which communicates with the vat 10. The feed tube 12 is a conduit or the like maintained at a temperature equal to or slightly below that of the vat 10.

The temperature in the feed tube 12 must not be below that at which the concentrated solution or melt solidifies. Thus, if the melt is formed at the lower end of the temperature range, the feed tube will be at a temperature equal to slightly below that of the vat 10. If higher temperatures are used in the vat 10, then, the temperature in the feed tube 12 will be lower than that of the vat 10. Ordinarily, the feed tube 12 is maintained at a temperature of from about 140° F. to about 200° F. and usually from about 145° F. to about 160° F. Means for heating the feed tube, such as a heating jacket 11, is used to control the temperature within the feed tube 12.

A screw mixer 14 or the like is disposed within the feed tube 12. The screw mixer is of conventional construction and is well-known in the art. The screw mixer is used to mix together the heat-alkaline sensitive material and the concentrated melt to form a substantially uniform mixture thereof and to transport the mixture, thus formed, to a distribution box 20, as described hereinafter.

As shown in the drawing, an inlet 15 is formed in the feed tube 12 intermediate the vat 10 and screw mixer 14 and provides fluid communication between a branch feed tube 18 and the tube 12. The branch feed tube 18 introduces a heat-alkaline sensitive material from a hopper 17 into the molten highly alkaline solution or melt. Because the heat-alkaline sensitive material is introduced downstream of the vat 10, there is less contact time with the alkaline material and the heat-alkaline sensitive material, thereby reducing the amount of reversion, if any, caused by "hot" contact between the heat-alkaline sensitive material and the molten alkaline material.

Ordinarily, the material is in contact with the melt, for a period ranging from about 4 to about 10 minutes.

Optimally, the heat-alkaline sensitive material is deployed as a particulate material, such as a flake, powder or granular material. Preferably, a granular form of heat-alkaline sensitive material is used. The material may be fed into the tube 12 through inlet 15 by gravity, pumped, belt fed or the like.

The heat-alkaline sensitive material is admixed with the alkaline material via the screw feed 14 or the like wherefrom the admixture is delivered to a distribution box or header 20. Ordinarily, the distribution box is maintained at a temperature ranging from about 140° F. to about 200° F. and, preferably, from about 145° F. to about 160° F. which permits to the alkaline material to remain in its molten or liquid state.

The distribution box 20 contemplated for use herein, generally, comprises a closed receptacle 22 in fluid communication with the feed tube 12, as shown, via an inlet 21.

A plurality of exit conduits or drop tubes 24 are disposed within the distribution box 20. The drop tube 24 issues liquid admixture from the distribution box onto a chill belt 28, as described below. Each drop tube 24 comprises a small diameter conduit having an inlet 25 and an outlet 26 and which have a substantial portion thereof projecting outwardly from the box 20. Because of the configuration and positioning of the drop tubes only when the solution level within the box is above a predetermined level which is equal to that of the lower edge 27 of each inlet 25 of each conduit 24 will there be fluid flow through the conduits 24. The liquid level in the distribution box can be maintained by either adjusting the circulation of fluid; the height of the drop tubes; by recirculating the liquid in the distribution box, or by adjusting the feed rate of the admixture into the box by any suitable means, such as by metering or the like.

Because of the configuration of the drop tubes and the maintenance of the liquid level in the distribution box 20, only drops of the admixture issue therefrom onto the chill belt 28.

Representative of the distribution box and drop tube construction and assembly is found in U.S. Pat. No. 2,268,888, the disclosure of which is hereby incorporated by reference.

A chill belt 28 is disposed immediately below the lower termini or outlet ports 26 of the drop tubes 24. The chill belt 28 receives thereon the liquid drops issuing from the drop tubes and solidifies and, thus, pelletizes the drops of liquid, usually in about 5 to 15 seconds.

The chill belt is an endless conveyor-type belt 48 which may be mechanically or electrically driven and which is maintained at a temperature sufficiently low to solidify the liquid dropping thereonto upon contact therewith via circulating coolant, spray coolant or the like, generally, denoted at 46. Ordinarily, the chill belt is maintained at a temperature ranging from about 45° F. to about 80° F. and, preferably, from about 50° F. to about 60° F. As is known to those skilled in the art cooling of the belt 28 is achieved via a cooling medium, such as water, or the like which is fed to the interior of the belt assembly from where it is sprayed, by sprayers 29, onto the underside of the belt 48.

Chill belts of the type contemplated for use herein are well-known and commercially available. Representative of the type of chill belt contemplated for use herein is that sold commercially by Sandvik Corporation.

It is further contemplated herein that the present invention include a means for introducing a chlorine source into the pellets. Thus, and as shown in the drawing a branch feed tube 30 is in fluid communication with the mixing tube 12 via an inlet 32. The branch feed tube 30 feeds a source of chlorine 34, such as a powder or particles, into the mixing tube downstream of the screw mixer 14. This permits the chlorine source to be admixed with the molten highly alkaline material and heat-alkaline sensitive material for a relatively short contact time prior to solidification, usually from about 4 to 10 minutes.

As is known to those skilled in the art to which the present invention pertains, chlorine degradation is quite prevalent in such highly alkaline detergent environment and is, ordinarily, upwards of 90 percent to 100 percent. By practicing the present invention chlorine degradation is reduced to about 50 percent or less. Reduction of chlorine degradation is achieved by the short contact time and the short time from the liquid state of the mixture to its solidification. Thus, although optional, active-chlorine may be incorporated into the pellets produced hereby.

From the box 20, the droplets are issued onto the chill belt and collected in the hopper 60, wherefrom they can then be packed into suitable containers (not shown). For safety purposes and to prevent moisture pick-up, a hood 62 and dry air purge unit 64 may be incorporated into the system, although not essential to the process.

In order to enhance uniformity of the mixture in the distribution box, a mill 70 may be interposed the outlet 21 of the feed tube 12 and the inlet 23 of the distribution box 20. The mill 70 breaks down into smaller particles the heat-alkaline sensitive materials and/or active-chlorine source material in the melt. The mill may be of any conventional construction and such mills are widely known and commercially available.

It is to be appreciated that the present invention is applicable to the formation of any type of detergent pellet, such as, those useful in laundering, food processing, and the like, but is particularly advantageous to the formation of warewashing detergents.

In practicing the present invention a wide variety of highly alkaline materials may be used. Representative of the alkaline materials useful in the practice of this invention include hydratable metal hydroxides, such as sodium hydroxide and potassium hydroxide; hydratable silicates, such as sodium metasilicate; as well as mixtures thereof.

As noted, because of the use of an intermediate feed and short contact times in the molten alkaline material, heat-alkaline sensitive material degradation is substantially reduced. Thus, the present invention is particularly advantageous for use with highly alkaline materials in admixture with sequestrants which ordinarily revert in a highly alkaline elevated temperature environment. Thus, the process of the present invention is particularly advantageous with sequestrants which revert in highly alkaline environments, such as, complex phosphate sequestrants, including sodium tripolyphosphate, sodium hexametaphosphate, and the like, as well as mixtures thereof. Phosphates, contemplated for use herein, are of the formula $M\ (PO_3M)_nOM$ or the corresponding cyclic compounds:

$$\overbrace{PO_3M\ (PO_3M)nPO_3M}^{\phantom{x}},$$

wherein M is an alkali metal and n is a number ranging from 1 to about 60, typically less than 10 for cyclic phosphates, typical examples of such phosphates being alkaline condensed phosphates (i.e. polyphosphates) such as sodium or potassium pyrophosphate, sodium or potassium tripolyphosphate, sodium or potassium hexametaphosphate, etc.; carbonates such as sodium or potassium carbonate; borates, such as sodium borate; etc.

It should be noted that organic sequestrants such as citric acid, the alkali metal salts of nitrilotriacetic acid (NTA), EDTA, gluconates, polyelectrolytes, and the like can be used herein.

Typical chlorine sources, where used, are the conventional hypochlorites, chlorinated isocyanurates and the like, as well as mixtures thereof.

In addition to those components previously described, other conventional detergent components and fillers can be included. For example, it is common to include, in addition to a source of available chlorine, a surfactant as well as a thickener. Surfactants are always normally included in a detergent compositions. Typically, a "surfactant" is a chemical compound with a hydrophobe/-hydrophile balance suitable to reducing the stability of protein foam and to improve detergency. The hydrophobicity can be provided by an oleophilic portion of the molecule (e.g. an aromatic alkyl or aralkyl group; an oxypropylene unit or oxypropylene chain, or other oxyalkylene functional groups other than oxyethylene, e.g. tetramethylene oxide). The hydrophilicity can be provided with oxyethylene units or chains or blocks and/or ester groups (e.g. organophosphate esters), salt-type groups, or salt-forming groups. Typically, surfactants are nonionic organic surface-active polymers having hydrophobic groups or blocks or chains and hydrophilic ester-groups, blocks, units, or chains, but anionic, cationic, and amphoteric surfactants are known. If a surfactant is included it may be included as a separate stream or in admixture with the alkaline material in the vat 10.

The thickener, where used, is ordinarily a polyelectrolyte, such as a polyacrylate, e.g. (~2000 to 20,000 M.W.)., which may be directly added to the vat 10 along with the alkaline material, preferably, with the original solution.

Figure 4:
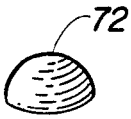
FIG. 4 is a perspective view of a pellet.

The alkaline material, which is a hydratable chemical or combination of hydratable chemicals will normally comprise at least 30 percent, and preferably 60 percent, or higher, by weight, e.g. 80 percent, of the pellets hereof and the heat-alkaline sensitive material from about 10 to about 50 percent, by weight, of the pellet. The water of hydration will normally comprise more than 5 weight-percent (e.g. 10–35 weight-percent) of the pellet composition. Performance-improving additives such as available-chlorine producing components and surfactants will normally comprise minor amounts of the composition, that is, about 5 percent by weight of the pellet. As used herein, the term "pellet" defines a particulate material having a flat bottom (FIG. 4) and an approximated rounded upper surface.

As noted, the present invention is particularly suited for the manufacture of highly caustic alkali metal hydroxide pellets containing a complex phosphate sequestrant, e.g. sodium tripolyphosphate with or without a chlorine source. However, and as noted, other detergent pellets can be manufactured hereby.

In the practice of the present invention, other types of pellets, such as active chlorine pellets, hydrated or anhydrous, highly alkaline material pellets, surfactant pellets and the like can be introduced onto the chill belt 28 or into the hopper 60 along with the alkaline-complex phosphate pellets, wherefrom they are deposited into a suitable container (not shown). Thus, it is possible to formulate a pellet detergent mixture such as:

(a) a first set of quantity of pellets of alkaline material-complex phosphate with or without active chlorine, as produced hereby;

(b) a second set of quantity of pellets of active chlorine; and (c) a third set or quantity of anhydrous or hydrated alkaline pellets; of course other pellets can be incorporated into such a composition.

Ordinarily, such a mixture will, principally, comprise from about 30 percent to 100 percent, by weight of the first quantity of pellets, from about 0 percent to about 20 percent by weight of the second quantity of pellets and from about 0 to about 70 percent by weight of the third quantity of pellets.

In principle, it is to be appreciated that there has been described herein a process for manufacturing highly alkaline detergent materials which reduces the problem of phosphate reversion normally encountered therewith by the short contact time between the phosphate and the molten alkaline material and the decreased time at which the product is formed.

Having, thus, described the invention, what is claimed is:

1. A multi-step mixing process for manufacturing a highly alkaline detergent pellet, comprising:

(a) heating a concentrated aqueous alkaline material or a mixture of alkaline material to an elevated temperature;

(b) dispensing the concentrated aqueous alkaline material into a feed tube;

(c) downstream of the feed tube mixing a sequestrant with the concentrated aqueous alkaline material to form a detergent mixture;

(d) feeding the mixture from the feed tube into a distribution box; and (e) dropping droplets of the mixture from the box onto a chill belt to form solid pellets thereof consisting of alkaline material and sequestrant.

2. The process of claim 1 wherein:

the sequestrant is in a granular form.

3. The process of claim 1 wherein the mixing device and the box are maintained at a temperature above the solidification temperature of the alkaline material.

4. The process of claim 1 wherein:

the alkaline material is heated to a temperature of at least 140° F.

5. The process of claim 1 wherein:

(a) the alkaline material is an alkali metal hydroxide;

(b) the sequestrant is an alkali metal complex phosphate; and wherein the pellets comprise from about 30 to about 80 percent by weight of alkali metal hydroxide and from about 10 to about 50 percent, by weight, of alkali metal complex phosphate.

6. In a multi-step process for minimizing phosphate reversion in a highly alkaline detergent pellet composition of the type wherein a highly alkaline material is admixed with a phosphate sequestrant, the improvement which comprises:

(a) heating a concentrated aqueous highly alkaline material or a mixture of highly alkaline materials to an elevated temperature;

(b) dispensing the concentrated aqueous alkaline material into a feed tube;

(c) downstream of the feed tube mixing an alkali metal complex phosphate sequestrant with the concentrated aqueous alkaline material in the feed tube to form a substantially molten mixture, the feed tube being at a temperature equal to or below that at which the concentrated solution is formed;

(d) feeding the molten mixture into a distribution box; and (e) dropping droplets of the molten mixture onto a chill belt to form solid detergent pellets consisting essentially of alkaline material and phosphate sequestrant.

7. The improvement of claim 6 wherein:

(a) the highly alkaline material is sodium hydroxide; and (b) the phosphate is sodium tripolyphosphate.

8. A multi-step mixing process for manufacturing a highly alkaline detergent pellet comprising:

(a) heating a concentrated aqueous alkaline material or mixture of alkaline material to an elevated temperature;

(b) dispensing the concentrated aqueous alkaline material into a feed tube;

(c) downstream of the feed tube, mixing a sequestrant with the concentrated aqueous alkaline material to form a detergent mixture;

(d) downstream of the sequestrant addition mixing a chlorine source with the sequestrant and the alkaline in the feed tube;

(e) feeding the mixture from the feed tube into a distribution box; and (f) dropping droplets of the mixture from the box onto a chill belt to form solid pellets consisting of alkaline material, sequestrant and chlorine.

* * * * *